United States Patent [19]

Mady et al.

[11] Patent Number: 4,761,189

[45] Date of Patent: Aug. 2, 1988

[54] PROCESS AND AQUEOUS COMPOSITIONS FOR TREATING METAL SURFACES

[75] Inventors: Raschad Mady, Pulheim; Christian Ries, Cologne; Roland Morlock, Bergheim, all of Fed. Rep. of Germany

[73] Assignee: Gerhard Collardin GmbH, Cologne, Fed. Rep. of Germany

[21] Appl. No.: 53,598

[22] Filed: May 20, 1987

Related U.S. Application Data

[63] Continuation of Ser. No. 773,081, Aug. 28, 1985, abandoned, which is a continuation of Ser. No. 555,323, Nov. 25, 1983, abandoned.

[30] Foreign Application Priority Data

Dec. 23, 1982 [DE] Fed. Rep. of Germany ..... 3247729

[51] Int. Cl.[4] ..... C23C 22/08

[52] U.S. Cl. ..... 148/6.16

[58] Field of Search ..... 148/6.16

[56] References Cited

U.S. PATENT DOCUMENTS

| | | | |
|---|---|---|---|
| 3,706,603 | 12/1972 | Vessey et al. | 148/6.2 |
| 3,989,550 | 11/1976 | Newhard | 148/6.16 |
| 4,084,014 | 4/1978 | Fabergas | 148/6.16 |
| 4,131,489 | 12/1978 | Newhard | 148/6.16 |
| 4,349,392 | 9/1982 | Herver | 148/6.2 |
| 4,359,345 | 11/1982 | Fonte | 148/6.16 |

FOREIGN PATENT DOCUMENTS

| | | | |
|---|---|---|---|
| 2249294 | 5/1973 | Fed. Rep. of Germany | 148/6.16 |
| 0037550 | 3/1978 | Japan | 148/6.2 |

*Primary Examiner*—Sam Silverberg

*Attorney, Agent, or Firm*—Ernest G. Szoke; Henry E. Millson, Jr.; Mark A. Greenfield

[57] ABSTRACT

The invention relates to a process for treating metal surfaces, preferably of aluminum, aluminum alloys and steel, for the subsequent application of organic coating compositions. The metal surfaces are wetted with an aqueous bath solution containing chromium(III)ions, fluoride ions and an organic film former which is soluble or homogeneously dispersible in water, after which the solution applied is dried and converted by heating into a water-insoluble film.

The bath solution preferably contains the following constituents and approximate quantities thereof: 0.5 to 10 g/l of chromium(III)ions, 0.55 to 11 g/l of fluoride ions, 0.6 to 12.5 g/l of phosphate ions, and 0.15 to 5.0 g/l of organic film former. The organic film former preferably used is a polymer containing free carboxyl groups, more preferably a homopolymer and/or copolymer of acrylic and/or methacrylic acid.

10 Claims, No Drawings

PROCESS AND AQUEOUS COMPOSITIONS FOR TREATING METAL SURFACES

This application is a continuation of application Ser. No. 773,081, filed 8/28/85, which is a continuation of application Ser. No. 555,323, filed 11/25/83 both are abandoned.

This invention relates to the preparation of cleaned metal surfaces, particularly sheets of aluminum, aluminum alloys and cold-rolled steel, but also other metal surfaces, for the subsequent application of organic coatings, and is intended in particular for the manufacture of metal packaging materials for use in the food packaging industry.

BACKGROUND OF THE INVENTION

So-called no-rinse processes are now generally known in connection with the chemical treatment of metal surfaces, for example, for the subsequent application of lacquers, adhesives and/or plastics. In no-rinse processes, the metal surface is cleaned in a first stage to remove oil, dirt and other residues. Any residues of chemicals from this first stage are removed by rinsing with water. In the following stage of the process, the clean metal surface is wetted with an aqueous bath solution which is not rinsed off, but instead is dried in situ on the metal surface and converted there into a solid film of the bath constituents. Surface quality, particularly in regard to corrosion prevention and the adhesion of subsequently applied covering layers, can be substantially improved by coatings such as these.

Originally, treatment solutions containing hexavalent chromium compounds were frequently proposed in the extensive prior-art literature on this subject. Due to the toxic nature of those compounds, the processes in question or rather the rinsing waters accumulating in them require elaborate effluent treatment.

The use of treatment solutions containing hexavalent and trivalent chromium salts together with film-forming agents are described, for example, in German Applications No. 17 69 582 and No. 29 03 311. In the first of these two references, an alkali silicate, for example, is said to be used as the inorganic film-forming agent. According to the second reference, polyacrylic acid is used as the organic film-forming agent. Due to the presence of hexavalent chromium in the aqueous bath liquids, these materials are unsuitable for use in the food industry.

German Application No. 27 11 431 describes a process for the surface treatment of metals, particularly iron, zinc, and aluminum, in which the cleaned metal surface is said to be wetted with an aqueous acid solution containing chromium(III) ions, phosphate ions and finely particulate silica. This treatment solution may additionally contain acetate ions, maleate ions, zinc ions and/or manganese ions. Although there is no need in this case to use the toxic chromium-(VI) ion, acidic dispersions containing silica and phosphate ions have the disadvantage of a limited pot life due to flocculation.

DESCRIPTION OF THE INVENTION

The object of the present invention is to provide a no-rinse process of the type discussed above together with suitable treatment solutions which are not attended by any of the disadvantages of known materials of this type and which are suitable in particular for use in the food packaging industry. At the same time, the process of the invention produces a bright, visually attractive finish on the metal surface which, despite subsequent overcoating with clear lacquers for example, satisfies the aesthetic requirements which are imposed in particular on the packaging of foods.

In a first embodiment, therefore, the present invention relates to a process for treating metal surfaces, particularly for the subsequent application of organic coating compositions, in which the metal surface is wetted with an aqueous bath solution containing chromium-(III) ions, fluoride ions and an organic film-forming agent which is soluble or homogeneously dispersible in water. The solution applied to the metal surface is dried thereon without intermediate rinsing and then converted by heating into a water-insoluble film.

In another embodiment, the invention relates to the aqueous bath solutions suitable for use in the present process and which are described in detail hereinafter.

The process according to the invention is suitable for the surface treatment of ferrous metals, aluminum or aluminum alloys, zinc, and/or magnesium. The invention is particularly useful for the pretreatment of sheets of aluminum or aluminum alloys and cold-rolled steel for their subsequent use in the food packaging field.

In a preferred embodiment of the invention, the surfacetreatment solution additionally contains phosphate ions. Aqueous bath solutions in which the active-substance components are present in the following concentration ranges are particularly suitable for use in the process of the invention: chromium-(III) ions—from about 0.5 to about 10 g/l; fluoride ions—from about 0.55 to about 11 g/l; phosphate ions—from about 0.6 to about 12.5 g/l; and organic film-forming agent—from about 0.15 to about 5 g/l .

In the process of the invention, a cleaned, rinsed, and dried metal surface, i.e. for example, the surface of sheets of the above-mentioned metals, are contacted in any convenient manner with the aqueous treatment solution (after the film of water from the rinsing step has been wiped off) in such a way that about 2 to about 20 ml and preferably about 3 to about 7 ml of the aqueous treatment solution are applied per square meter of surface. In addition, the quantities of the above-mentioned active constituents in the aqueous treatment solution per square meter of metal surface to be treated should lie within the following limits: chromium-(III)ions—from about 5 to about 100 mg; fluoride ions—from about 5.5 to about 110 mg; phosphate ions—from about 6 to about 125 mg; and organic film forming agent soluble or homogeneously dispersible in water—from about 1.5 to about 35 mg.

In a preferred embodiment, the liquid film applied to the metal surface is left to act thereon for a reaction time of from about 1 to about 10 seconds, after which the film is dried and heat-treated at elevated temperature. However, the process steps of reaction with the metal surface and drying can also be combined. After drying, the metal surface is left with a formable, water-insoluble solid film having a weight per unit area of from about 18 to about 370 mg/m$^2$ and preferably from about 50 to about 250 mg/m$^2$ of metal surface. The drying and/or heat-treatment of the liquid film or rather the chemicals applied therewith can be carried out at temperatures in the range of from about 50° to about 300° C.

The easiest way to introduce chromium-(III)ions and fluoride ions into the bath is to use chromium-(III)-fluoride, the ratio of chromium-(III)ions to fluoride ions varying from about 1:2.5 to about 1:3.5. The phosphate content is provided by the addition of phosphates or phosphoric acid, followed by partial neutralization. In this connection, the phosphate content per mole of chromium-(III)ions is preferably equivalent to a molar ratio of from about 0.3 to about 3.0. The organic film-forming agent is preferably a synthetic polymer with a content of free carboxyl groups in number sufficient to ensure its solubility or homogeneous dispersibility in water. Suitable organic film formers are, in particular, polymers of acrylic acid and/or methacrylic acid which, in addition, can also contain limited quantities of copolymers, and the corresponding esters, nitriles, and/or amides of such polymers and copolymers. Preferred organic film formers are soluble polyacrylic acids which are clear in solution and which retain their solubility in the pH-range of the aqueous treatment solutions, which is normally between between about pH 2 and pH 3. These polyacrylic acids are generally polyacrylic acids having a molecular weight which is not too high; for example, polyacrylic acids having molecular weights of up to about 150,000 and preferably up to about 100,000.

The aqueous treatment solutions of the invention can be applied to the precleaned metal sheets by any method capable of producing a uniform, defined liquid film in the quantities disclosed above on the metal surface. Methods of application which have proved to be effective include roll coating using two or three rolls, and also wetting of the sheet by spraying or dipping, followed by removal of the surplus liquid film, for example, by plastic-coated levelling rolls or adjustable air knives.

Both acidic and alkaline cleaners can be used for the cleaning pretreatment of the metal surfaces to be wetted in accordance with the invention. The layers obtained with the aqueous treatment solution of the invention provide a uniform bright finish without any discoloration of the substrate. In combination with suitable subsequently applied organic coatings, they satisfy the requirements for use in the food-packaging field.

The invention will be illustrated by the following examples, which are given for purposes of illustration only and not to limit the invention.

EXAMPLE 1

Aluminum sheet of the alloy AlMg 5 was first cleaned and degreased by spraying in a sheet coating line. An acidic solution containing 1 g/l of $H_2SO_4$, 0.2 g/l of HF and 1 g/l of a surfactant combination was used for this purpose. Cleaning was carried out for 8 seconds at a temperature of 60° C. and with a spraying pressure of 1.5 bars. The sheet was then rinsed with warm deionized water and the rinsing water squeezed off. A liquid film of the solution according to the invention was then applied by roll coating in a quantity of 5 ml per square meter of surface, so that the surface is covered by a liquid film containing 25 mg of $Cr^{3+}$, 27.5 mg of $F^-$, 31.3 mg of $PO_4^{---}$ and 8.75 mg of polyacrylic acid ("Acrylsol A 1", a product of the Rohm and Haas Company of Philadelphia, Pa.) per square meter of surface.

After a reaction time of 3 seconds, the water present in the liquid film was evaporated off in a suspension dryer with a recirculating air temperature of 100° C. and a metal object temperature of approximately 50° C., leaving a water-insoluble film weighing 92.5 mg/m$^2$ behind on the metal surface.

The sheet thus pretreated was then coated with a PVC lacquer (No. 8510-E-14-M of the Dexter Midland Co.) and baked at a metal object temperature of 240° C.

This sheet chemically pretreated by the present no-rinse technique and then lacquered was made up into lids for beverage cans and, together with commercially used lids having conventional conversion layers for comparison, was subjected to the tests designed for beverage cans.

In every case, the results obtained with the lids from the sheet pretreated in accordance with the invention were as good as or better than those obtained with conventionally pretreated sheet.

EXAMPLE 2

To prepare a treatment solution in accordance with the invention, 2640 g of chromium oxide hydrate containing 25% of $Cr_2O_3$ were dissolved while stirring in a mixture, heated to 60° C., of 4710 g of deionized water, 1300 g of 40% hydrofluoric acid and 750 g of 75% phosphoric acid. After the solution had been cooled to 30° C., 2640 g of polyacrylic acid (Rohm & Haas' Acrysol A 1) were added again with stirring. The resulting solution was diluted with 88.5 liters of deionized water and used for filling chemcoater tanks.

The rotational speeds of the chemcoater rolls were regulated in such a way that a liquid film of 8 ml per square meter of surface was applied by the rolls of the chemcoater to a cleaned, water-rinsed aluminum sheet travelling at a speed of 100 meters per minute. As a result of this treatment, the band was wetted with a liquid film which, per square meter of surface, contained 40 mg of $Cr^{3+}$, 44 mg of $F^-$, 50 mg of $PO_4^{---}$ and 14 mg of 100% polyacrylic acid and which, after drying, has a weight per unit area on the aluminum of 148 mg/m$^2$.

After a reaction time of 3 seconds, the water present in the liquid film was removed by means of a warm air dryer, after which the sheet was heated to an object temperature of 200° C. After cooling, the film obtained on the sheet was wetted for lubrication with 8 to 10 mg of dioctyl sebacate. The chemically pretreated aluminum surface thus obtained was coated with food-grade lacquers and tested for its resistance to fillings and for its formability. In all the tests, the results obtained with the process of the invention were at least as good as and, in some cases, even better than those obtained with conventional commercially used solutions and processes.

What is claimed is:

1. A process for treating a clean metal surface for subsequent application of an organic coating comprising the sequential steps of:

(a) applying to the surface of a metal which is aluminum, an aluminum alloy, or steel, a coating consisting of an aqueous solution of
  (i) about 0.5 to 10 g/l of trivalent chromium ions,
  (ii) about 0.55 to 11 g/l of fluoride ions,
  (iii) about 0.15 to 500 g/l of an organic film-forming agent which is a homopolymer or copolymer of acrylic acid or methacrylic acid, containing free carboxyl groups, and
  (iv) about 0.6 to 12.5 g/l of phosphate ions, the mol ratio of trivalent chromium ions to fluoride ions to phosphate ions being about 1:2.5 to 3.5:0.3 to 3.0;

(b) removing the metal surface form contact with the aqueous solution except for a thin layer of the aqueous solution which is left thereon;

(c) removing the water from said thin layer of the aqueous solution present on the metal surface to form a thin film on the metal surface; and (d) heating the film at a temperature and for a period of time sufficient to render the film water-insoluble.

2. A process in accordance with claim 1 wherein the polymer is an acrylic acid polymer having substantial solubility in water at a pH of from about 2 to about 3.

3. A process in accordance with claim 1 wherein the aqueous solution contains, per square meter of metal surface to be treated, from about 5 to about 100 mg of trivalent chromium ions; from about 5.5 to about 110 mg of fluoride ion; from about 6 to about 125 mg of phosphate ions; and from about 1.5 to about 35 mg of organic film-forming agent.

4. A process in accordance with claim 1 wherein in step (b) the layer of the aqueous solution remaining on the metal surface is from about 2 to about 20 ml per $m^2$ of metal surface.

5. A process in accordance with claim 1 wherein the layer is from about 3 to about 7 $ml/m^2$.

6. A process in accordance with claim 1 wherein in step (c) the water is removed from the layer by drying at a temperature of from about 50° to about 300° C.

7. A process in accordance with claim 6 wherein in step (d) the film is heated at a temperature of from about 50° to about 300° C.

8. A process in accordance with claim 1 wherein the water-insoluble film in step (d) has a weight per unit area of from about 18 to about 370 $mg/m^2$.

9. A process in accordance with claim 8 wherein the weight per unit area is from about 50 to about 250 $mg/m^2$.

10. An aqueous bath solution for the treatment of clean surfaces of a metal which is aluminum, an aluminum alloy, or steel, consisting of: an aqueous solution of (i) about 0.5 to 10 g/l of trivalent chromium ions;

(ii) about 0.55 to 11 g/l of fluoride ions;

(iii) about 0.6 to 12.5 g/l of phosphate ions; and (iv) about 0.15 to 5.0 g/l of an organic film-forming agent which is a homopolymer or copolymer of acrylic acid or methacrylic acid, containing free carboxyl groups, and which is soluble or homogeneously dispersible in water having an acidic pH of about 2 to 3;

wherein the mol ratio of trivalent chromium ions to fluoride ions to phosphate ions is about 1:2.5 to 3.5:0.3 to 3.0.

* * * * *

UNITED STATES PATENT AND TRADEMARK OFFICE

CERTIFICATE OF CORRECTION

PATENT NO. : 4,761,189

DATED : August 2, 1988

INVENTOR(S) : Raschad Mady, Christian Ries, Roland Morlock

It is certified that error appears in the above-identified patent and that said Letters Patent is hereby corrected as shown below:

At Col. 4, line 58, in claim 1, "500 g/l" should read --5.0 g/l--.

At Col. 4, line 66, in claim 1, "form" should read --from--.

Signed and Sealed this

Thirteenth Day of March, 1990

*Attest:*

JEFFREY M. SAMUELS

*Attesting Officer*

*Acting Commissioner of Patents and Trademarks*